US011680769B1

(12) United States Patent
Hepler

(10) Patent No.: US 11,680,769 B1
(45) Date of Patent: Jun. 20, 2023

(54) AIR GUN MAGAZINE LOADING DEVICE

(71) Applicant: Doug Hepler, Rochester, NY (US)

(72) Inventor: Doug Hepler, Rochester, NY (US)

(73) Assignee: Douglas C. Hepler, Rochester, NY (US)

( * ) Notice: Subject to any disclaimer, the term of this patent is extended or adjusted under 35 U.S.C. 154(b) by 0 days.

(21) Appl. No.: 17/567,114

(22) Filed: Jan. 1, 2022

(51) Int. Cl.
*F41B 11/54* (2013.01)
*F41B 11/51* (2013.01)

(52) U.S. Cl.
CPC ..... *F41B 11/54* (2013.01); *F41B 11/51* (2013.01)

(58) Field of Classification Search
CPC ..... F41B 1/51–54
USPC ..... 124/45, 48
See application file for complete search history.

(56) References Cited

U.S. PATENT DOCUMENTS 4,986,251 A * 1/1991 Lilley ..... F41B 11/55 124/52
4,993,400 A * 2/1991 Fitzwater ..... F41B 11/54 124/48
2018/0073831 A1* 3/2018 Zhu ..... F41B 11/50
2020/0158455 A1* 5/2020 Greene ..... F41A 9/85
2021/0222991 A1* 7/2021 Kowalczyk, Jr. ..... F41B 11/54

FOREIGN PATENT DOCUMENTS

GB 2484536 A * 4/2012 ..... F41B 11/54

* cited by examiner

*Primary Examiner* — Bret Hayes

(57) ABSTRACT

An air gun magazine loading device is disclosed. The device comprises a pellet sorter including a plurality of undercuts proximal to its outer edge, a magazine interface having a base plate including a plurality of holes and a raised section with plurality of undercuts, and an elevator ring with one or more ramps at its upper surface. The pellet sorter forms a plurality of round holes in a closed position to sort a plurality of pellets into the round holes. The magazine interface positions the magazine holes in-line with the holes in the pellet sorter. The elevator ring is rotated to raise the pellet sorter to an open position and bisects the round holes, thereby creating a space for the pellets and allowing the pellets to move in the direction of the raised section where the pellets directly fall through the holes into the air gun magazine or open area.

15 Claims, 12 Drawing Sheets

AIR GUN MAGAZINE LOADING DEVICE

FIELD OF THE INVENTION

The present invention generally relates to pellets loading devices. More specifically, the present invention relates to a magazine loading device for an air gun for automatically sorting and loading pellets directly into a magazine.

BACKGROUND

An air gun is a gun that fires projectiles pneumatically. Air guns are used for hunting, pest control, recreational shooting, and competitive sports. The air gun includes a magazine that is inserted into and removed from a magazine holding section. The conventional air gun magazine is constructed from a substantial magazine body of a solid shape provided with a rotary clip(s) at one or both ends. This magazine is held in a magazine holding section briefly formed from a cavity in the air gun body. The magazines are provided for holding a plurality of pellets to give the guns a multi-shot capability, avoiding the need for manual insertion of a pellet into the breech for each shot. Typical air gun magazines are loaded with one pellet at a time by hand.

Few existing patent references are cited as prior art over the presently disclosed subject matter and are explained as follows:

A prior art U.S. Ser. No. 10/816,290 B2 to Leonard Greene, entitled "System and method for loading clips" discloses a system for loading pellets into clips includes a clip plate defining a plurality of clip openings; a pellet plate with pellet openings; a loading plate with loading pegs; and a base with a base plate surrounded by a base wall, the base plate and base wall defining a base cavity constructed to accept the clip plate, the pellet plate, and the loading plate in more than one axial orientation.

Another prior art U.S. Ser. No. 10/533,817 B1 to Brandon Thomas Hefer, et. al., entitled "Electric magazine loader" discloses a magazine loader for loading cartridges into a magazine includes a base and a housing supported by the base. The base and the housing support a bowl for receiving a plurality of cartridges. A wheel is disposed inside the bowl cavity defined by the bowl. Cartridges are circulated in the bowl upon rotation of the wheel and exit the bowl via an aperture while the cartridges are assuming either a first orientation or a second orientation. A series of cartridges having random orientations are fed to a sorter of the magazine loader. The sorter is operable to receive a first cartridge and rotate the first cartridge clockwise 90 degrees if the random directional orientation of the first cartridge is the first directional orientation and/or rotate the first cartridge counterclockwise 90 degrees if the random directional orientation of the first cartridge is the second directional orientation.

Though the above-mentioned prior arts disclose magazine loading, they fail to disclose about automatic loading of air gun magazines. Also, they fail to provide a space to allow the pellets to fall through the magazine loading device. In addition, the existing devices fails to allow the pellets to be directly loaded into the magazine.

Therefore, there is a need for a magazine loading device configured to provide automatic sorting and loading of pellets directly into a magazine. Also, there is a need for a device configured to create a space for the pellets to move sideways slightly and fall into the air gun magazine.

SUMMARY OF THE INVENTION

The present invention generally discloses a magazine loading device for an air gun for automatically sorting and loading pellets directly into a magazine. Also, the present invention discloses a device configured to create a space for the pellets to move slightly and fall down into the air gun magazine.

The device is an innovative and intelligent product that has been designed to automatically sort and load a plurality of pellets into a magazine of an air gun. In one embodiment, the device comprises a stationary unit and a rotating unit. The stationary unit comprises a top section or pellet sorter and a bottom section or a magazine interface. In one embodiment, the magazine is inserted into the magazine interface configured to load a plurality of pellets. In one embodiment, the rotating unit is a center section or an elevator ring.

In one embodiment, the pellet sorter comprises a plurality of undercuts proximal to its outer edge and an outer rim or outer ring area at a periphery of the pellet sorter. In one embodiment, the magazine interface comprises a base plate and a center elevation or raised section. The undercuts extend downwards until to reach the base plate, thereby forming a round or pellet sorter holes while not in use. In one embodiment, the outer rim of the pellet sorter and the raised section of the magazine interface form a top sorting surface or inner area of the pellet sorter, thereby providing the round hole of the pellet sorter for sorting pellets. The base plate has a plurality of base plate holes. The raised section comprises a plurality of undercuts along its height at its outer periphery towards the holes in the base plate. In one embodiment, the undercuts array the holes in the magazine to the correct positions to line the holes in the magazine with the holes in the pellet sorter. In one embodiment, the pellet sorter forms a plurality of round holes in a closed position to sort a plurality of pellets into the round holes. In one embodiment, the magazine interface positions the magazine holes in-line with the holes in the pellet sorter.

In one embodiment, the elevator ring has one or more ramps at its upper surface. The elevator ring is rotated to raise the pellet sorter to an open position. In one embodiment, the elevator ring is rotated to raise the pellet sorter and bisects the round holes, thereby creating a space for the pellets and allowing the pellets to move in the direction of the raised section where the pellets fall through the holes into the air gun magazine or open area.

In one embodiment, the pellet sorter has one or more pellet sorter tabs and the magazine interface has one or more magazine interface tabs. In one embodiment, the one or more pellet sorter tabs and magazine interface tabs are positioned in-line and connected using one or more fasteners and springs via the sliding holes of the elevator ring. In one embodiment, the pellet sorter, elevator ring, and magazine interface are attached together using one or more fasteners. In one embodiment, the pellet sorter further comprises a mounting hole on each pallet sorter tab configured to receive the fasteners. In one embodiment, the elevator ring has one or more sliding holes at its outer periphery. In one embodiment, the elevator ring further comprises one or more ramps configured to support the rotation of the elevator ring. In one embodiment, the pellet sorter further comprises one or more channels configured to allow the ramps to slide into the channels to support the rotation of the elevator ring.

In one embodiment, a process or method of loading pellets into an air gun magazine using a magazine loading device is disclosed. At one step, the air gun magazine is inserted onto the magazine interface. In one embodiment, the undercuts in the magazine interface array it into the correct positions to line the holes in the magazine with the pellet sorter holes in the pellet sorter. At another step, a plurality of pellets are poured into the pellet sorter. At another step, the pellets are sorted and loaded into the pellet sorter holes with their head down in a closed position by swirling/shaking. At another step, the outer rim of the pellet sorter is raised by rotating the elevator ring to an open position and bisects the pellet sorter holes, thereby creating a space for the pellets and allowing the pellets to move in the direction of the raised section. At another step, the pellets fall through the round holes into the air gun magazine or open area.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

The present invention is best understood by reference to the detailed figures and description set forth herein.

It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
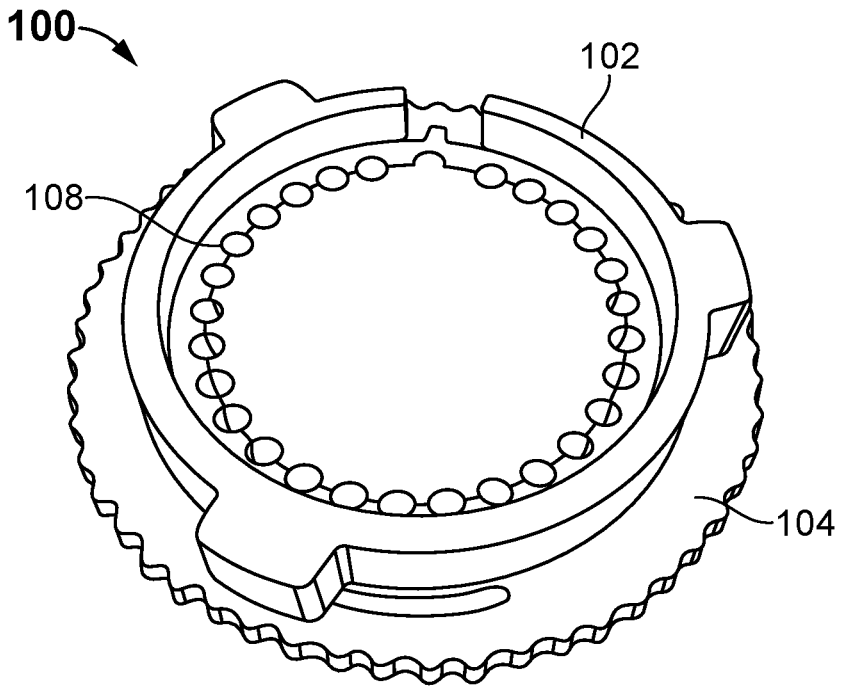
FIG. 1 shows a perspective view of a magazine loading device in an embodiment of the present invention.
Figure 2:
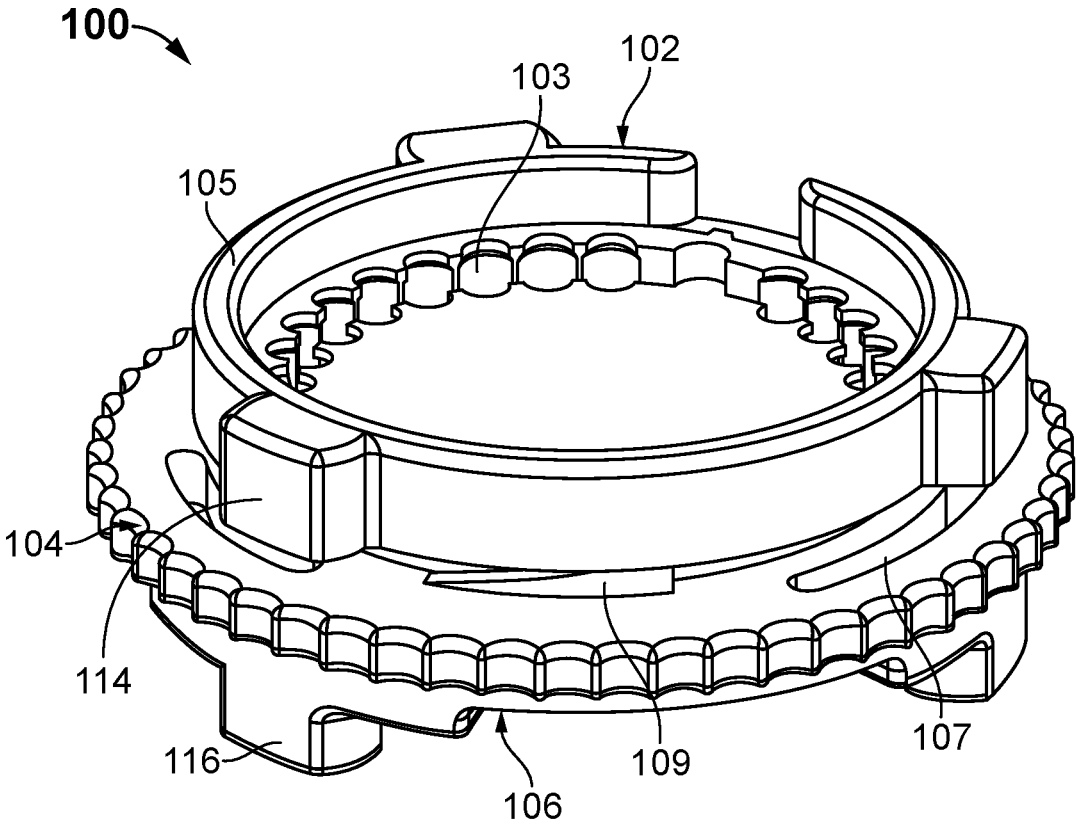
FIG. 2 a side perspective view of the magazine loading device in one embodiment of the present invention.
Figure 3:
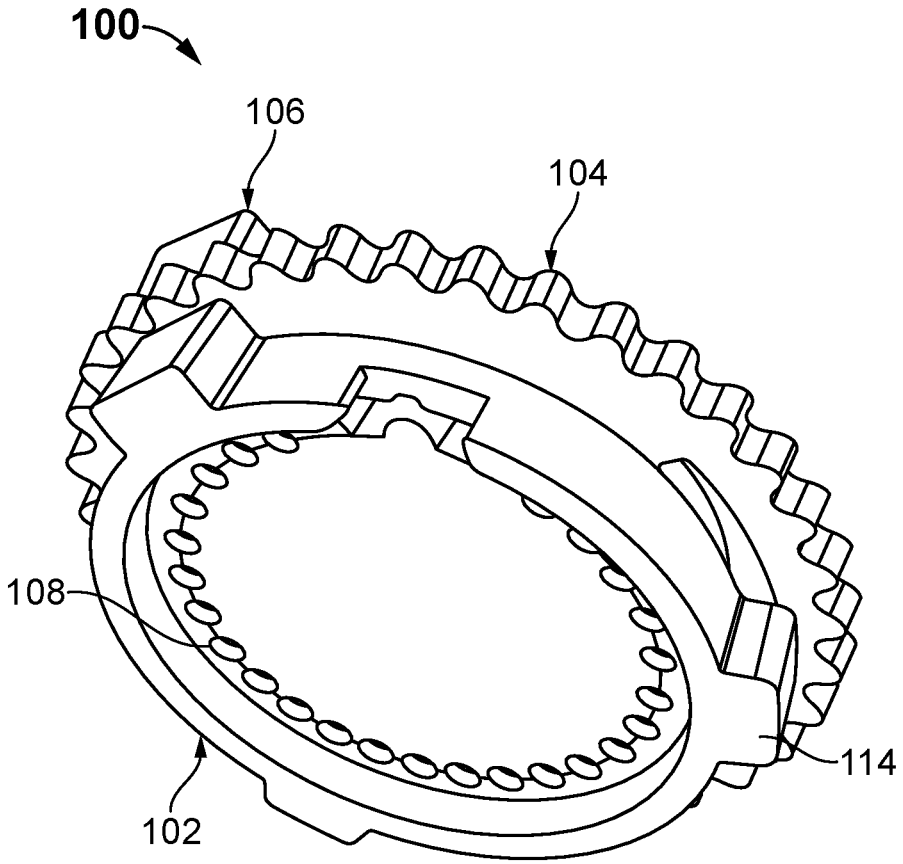
FIG. 3 shows a front perspective view of the magazine loading device in one embodiment of the present invention.
Figure 4:
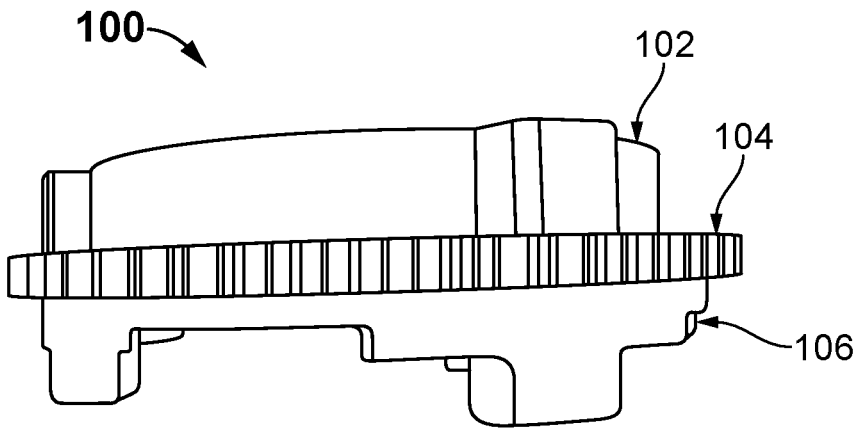
FIG. 4 shows a side view of the magazine loading device in one embodiment of the present invention.
Figure 5:
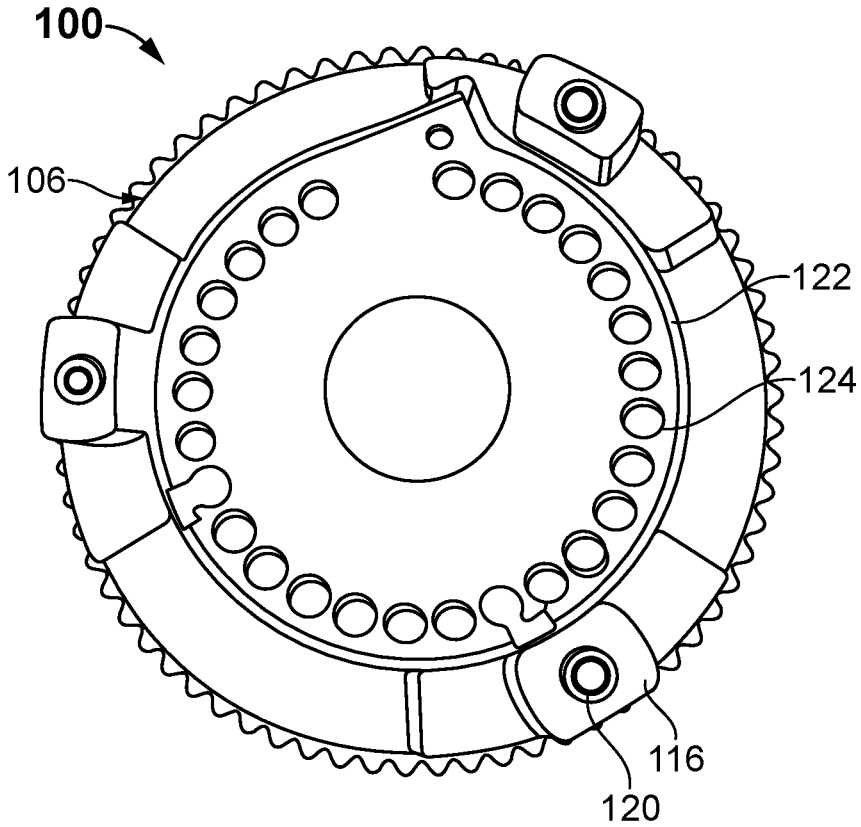
FIG. 5 shows a rear view of the magazine loading device in one embodiment of the present invention.
Figure 13:
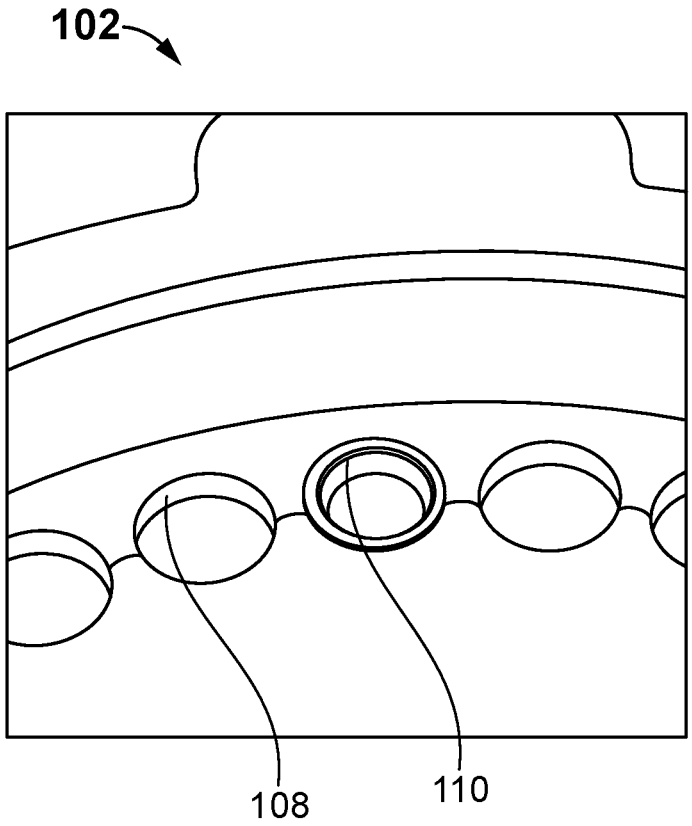
FIG. 13 shows an enlarged view of the magazine loading device in a closed position in one embodiment of the present invention.

Referring to FIG. 1, a perspective view of a magazine loading device (hereinafter referred as device) 100, according to one embodiment of the present invention. The device 100 is an innovative and intelligent product that has been designed to automatically sort and load a plurality of pellets 110 into a magazine 112 (as shown in FIG. 13) of an air gun. In one embodiment, the device 100 comprises a stationary unit and a rotating unit. The stationary unit comprises a top section or pellet sorter 102 and a bottom section or a magazine interface 106. In one embodiment, the magazine interface 106 is inserted with the air gun magazine configured to load a plurality of pellets 110. In one embodiment, the rotating unit is a center section or an elevator ring 104. In one embodiment, the pellet sorter 102 forms a plurality of round holes or pellet sorter holes 108 in a closed position to sort a plurality of pellets 110 (as shown in FIG. 13) into the pellet sorter holes 108.

Referring to FIGS. 2-5, various views of the magazine loading device 100, according to one embodiment of the present invention. In one embodiment, the device 100 comprises a stationary unit and a rotating unit. The stationary unit comprises a top section or pellet sorter 102 and a bottom section or a magazine interface 106. In one embodiment, the pellet sorter 102 comprises a plurality of undercuts 103 proximal to its outer edge and an outer rim or outer ring area 105 at a periphery of the pellet sorter 102. In one embodiment, the pellet sorter 102 comprises one or more pellet sorter tabs 114. In one embodiment, the air gun magazine 112 is inserted into the magazine interface 106 configured to load the pellets 110. In one embodiment, the magazine interface 106 comprises one or more magazine interface tabs 116.

In one embodiment, the rotating unit is a center section or an elevator ring 104. In one embodiment, the elevator ring 104 has one or more ramps 109 that cause the pellet sorter 102 to rise. In one embodiment, the ramps 109 are configured to support the rotation of the elevator ring 104. In one embodiment, the elevator ring 104 further comprises one or more sliding holes 107 at its outer periphery. In one embodiment, the pellet sorter 102, elevator ring 104, and magazine interface 106 are attached together using one or more fasteners 120. In one embodiment, the fasteners 120 may be threaded screws.

In one embodiment, the magazine interface 106 has a base plate 122 including a plurality of base plate holes 124. In one embodiment, the outer rim 105 of the pellet sorter 102 and the raised section 126 of the magazine interface 106 form a top sorting surface or inner area of the pellet sorter 102, thereby providing the round hole 108 of the pellet sorter 102 for sorting pellets 110. In one embodiment, the elevator ring 104 is rotated by sliding the ramps 109 to raise the pellet sorter 102 to an open position and bisects the pellet sorter holes 108, thereby creating a space for the pellets 110 and allowing the pellets 110 to move in the direction of the raised section 126 where the pellets 110 fall through the base plate holes 124 into the air gun magazine 112 or open area.

Figure 6:
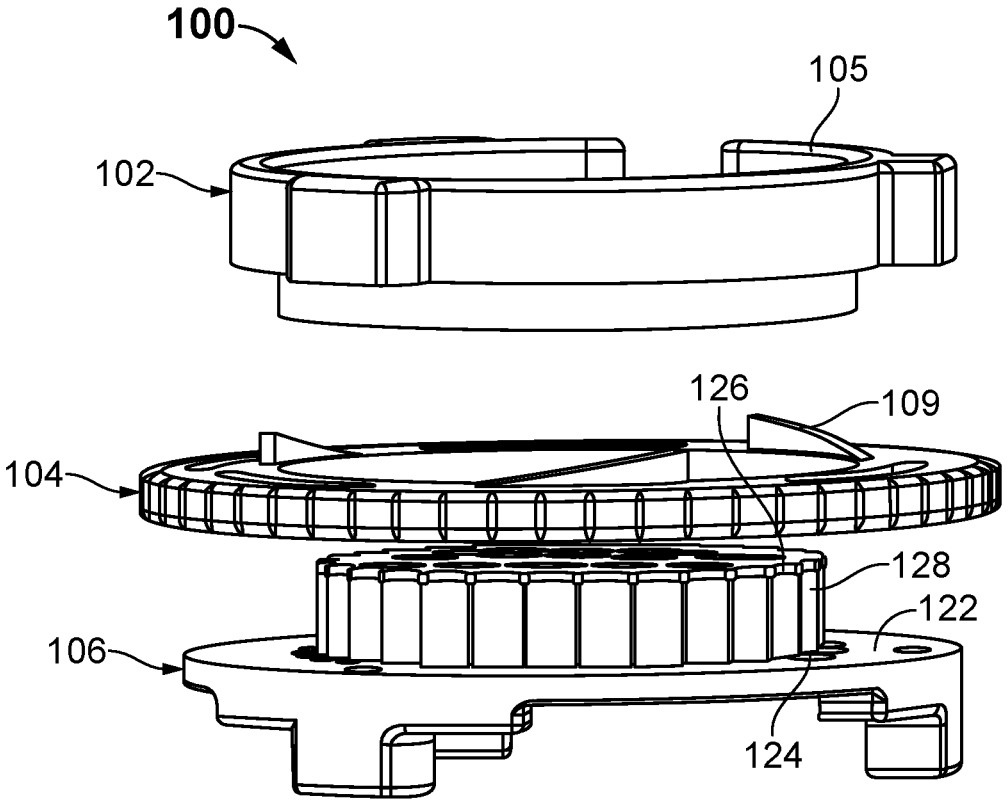
FIG. 6 shows an exploded view of the magazine loading device in one embodiment of the present invention.

Referring to FIG. 6, an exploded view of the magazine loading device 100, according to one embodiment of the present invention. The device 100 comprises a top section or pellet sorter 102, a rotating unit or a center section or an elevator ring 104, and a bottom section or a magazine interface 106. In one embodiment, the pellet sorter 102, elevator ring 104, and magazine interface 106 are attached together using one or more fasteners 120. In one embodiment, the pellet sorter 102 elevates when the elevator ring 104 is rotated. In one embodiment, the elevator ring 104 has one or more ramps 109 that cause the pellet sorter 102 to rise.

In one embodiment, the magazine interface 106 positions a plurality of magazine holes 130 (as shown in FIG. 13) in-line with the pellet sorter holes 108. In one embodiment, the magazine interface 106 has a base plate 122 including a plurality of base plate holes 124 and a center elevation or raised section 126 having a plurality of undercuts 128 along its height at its outer periphery towards the base plate holes 124. In one embodiment, the outer rim 105 of the pellet sorter 102 and the raised section 126 of the magazine interface 106 form a top sorting surface or inner area of the pellet sorter 102, thereby providing the round hole 108 of the pellet sorter 102 for sorting pellets 110. In one embodiment, the elevator ring 104 is rotated to raise the pellet sorter 102 to an open position and bisects the pellet sorter holes 108, thereby creating a space for the pellets 110 and allowing the pellets 110 to move in the direction of the raised section 126 where the pellets 110 fall through the base plate holes 124 into the air gun magazine 112 or open area.

Figure 7:
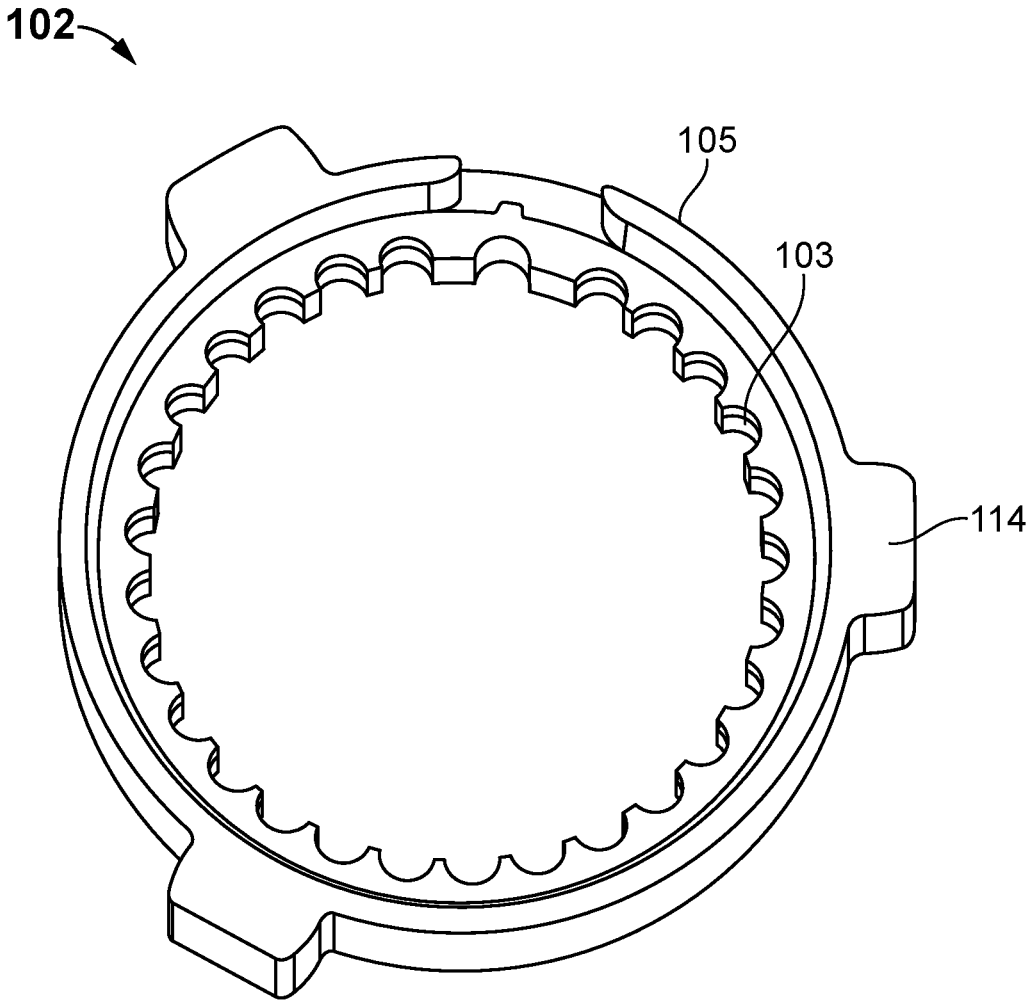
FIG. 7 shows a front perspective view of a top section or pellet sorter of the magazine loading device in one embodiment of the present invention.
Figure 8:
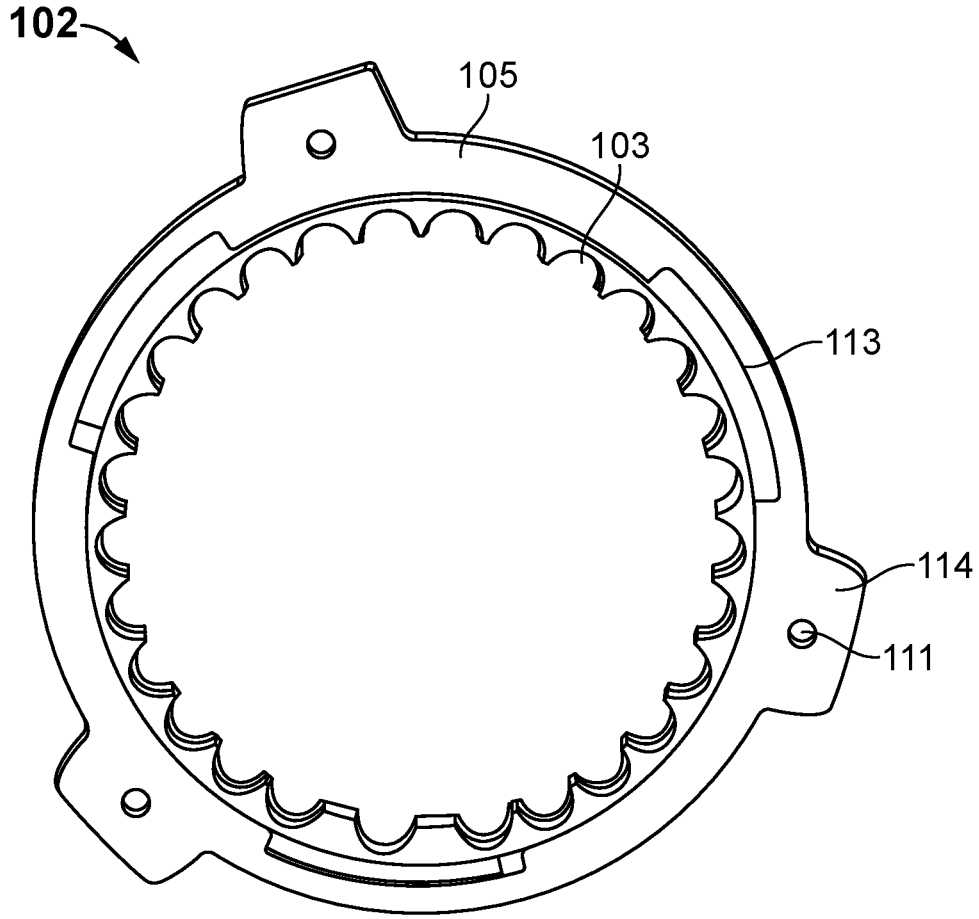
FIG. 8 shows a rear view of the pellet sorter of the magazine loading device in one embodiment of the present invention.
Figure 9:
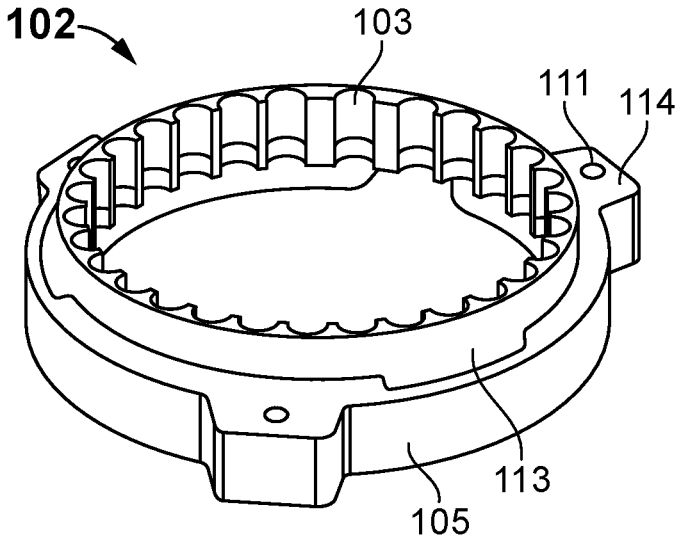
FIG. 9 shows a rear perspective view of the pellet sorter of the magazine loading device in one embodiment of the present invention.

Referring to FIG. 7-9, a various view of the pellet sorter 102, according to one embodiment of the present invention. In one embodiment, the pellet sorter 102 has a plurality of undercuts 103 proximal to its outer edge and an outer rim 105 at a periphery of the pellet sorter 102. The undercuts 103 extend downwards along the length of the outer rim 105, which is in-line with the undercuts 128 of the raised section 126 to form the pellet sorter holes 108 in the closed position. In one embodiment, the pellet sorter 102 further comprises a mounting hole 111 on each pallet sorter tab 114 configured to receive the fasteners. In one embodiment, the pellet sorter 102 further comprises one or more channels 113 configured to allow the ramps 109 to slide into the channels 113 to support the rotation of the elevator ring 104.

Figure 10:
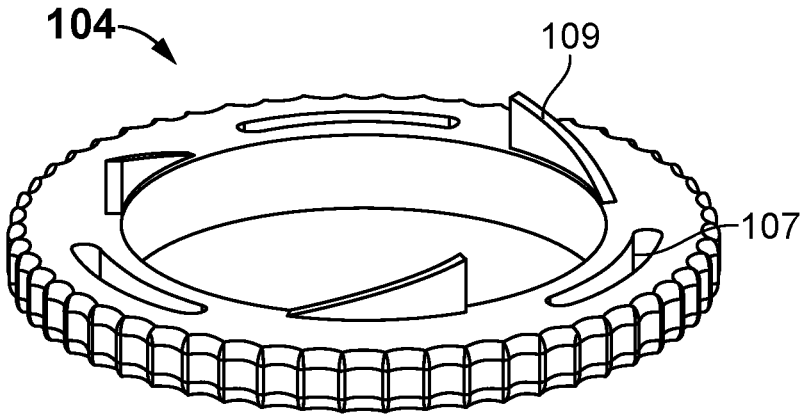
FIG. 10 shows a top perspective view of an elevator ring in one embodiment of the present invention.

Referring to FIG. 10, a side perspective view of the elevator ring 104, according to one embodiment of the present invention. The elevator ring 104 is a rotating unit, which is placed between two stationary units such as pellet sorter 102 and magazine interface 106. In one embodiment, the elevator ring 104 has one or more ramps 109 that cause the pellet sorter 102 to rise. In one embodiment, the ramps 109 are configured to support the rotation of the elevator ring 104. In one embodiment, the elevator ring 104 further comprises one or more sliding holes 107 at its outer periphery. The sliding holes 107 allow the maximum rotation of the elevator ring 104. In one embodiment, the elevator ring 104 rotates along the length of the sliding holes 107.

Figure 11:
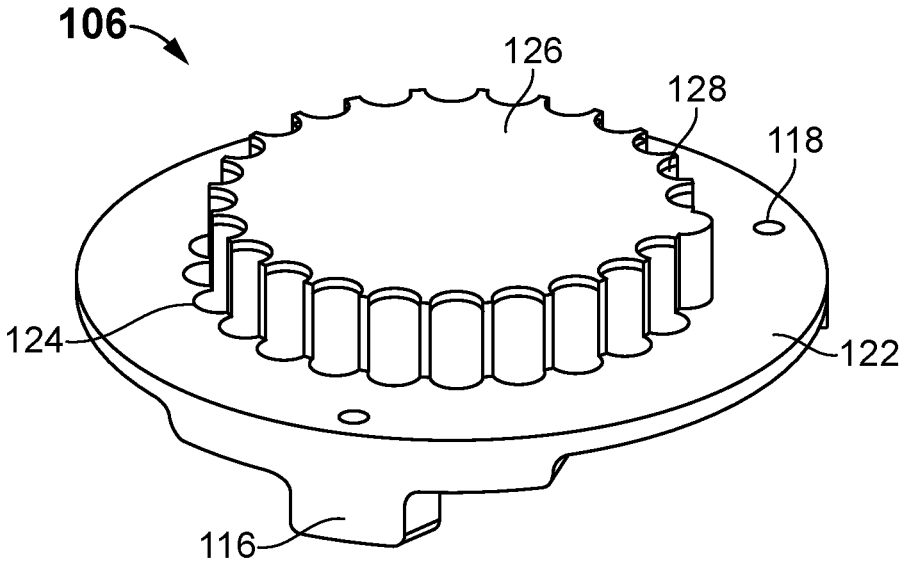
FIG. 11 shows a top perspective view of a magazine interface of the magazine loading device in one embodiment of the present invention.
Figure 12:
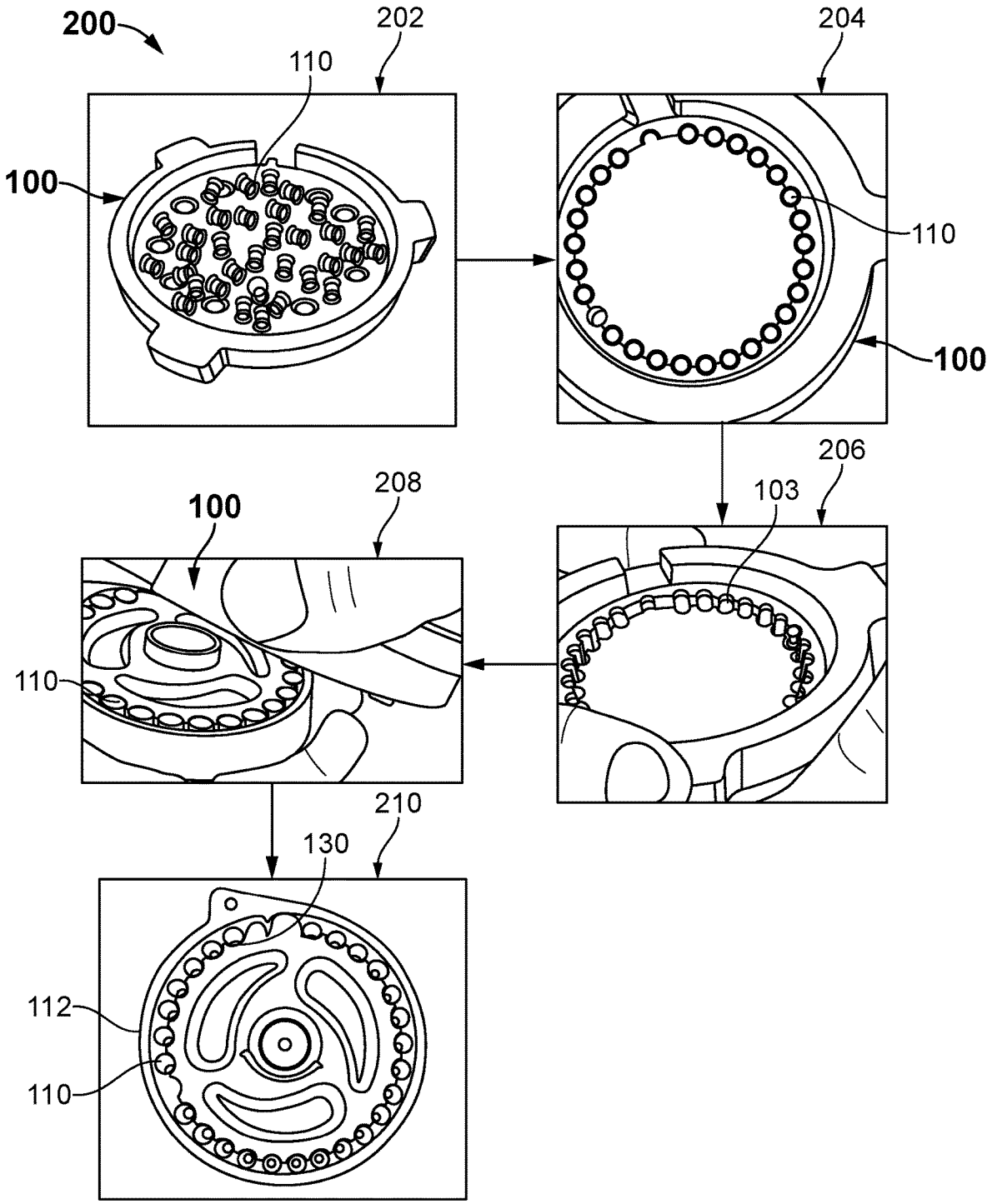
FIG. 12 shows a process of loading a magazine with a plurality of pellets in one embodiment of the present invention.

Referring to FIGS. 11-12, a top perspective view and a top view of the magazine interface 106, according to one embodiment of the present invention. In one embodiment, the magazine interface 106 has a base plate 122 including a plurality of base plate holes 124 and a center elevation or raised section 126 having a plurality of undercuts 128 along its height at its outer periphery towards the base plate holes 124. In one embodiment, the base plate 122 further comprises one or more mounting holes 118 along the magazine interface tabs 116 configured to allow the fastener to pass through it to attach the magazine interface 106 with the pellet sorter 102 and elevator ring 104.

Referring to FIG. 13, a process or method 200 of loading pellets into an air gun magazine 112 using a magazine loading device 100, according to one embodiment of the present invention. In one embodiment, the device 100 comprises a top section or pellet sorter 102 including a plurality of undercuts 103 proximal to its outer edge and an outer rim 105 at a periphery of the pellet sorter 102, a bottom section or a magazine interface 106 having a base plate 122 including a plurality of base plate holes 124 and a center elevation or raised section 126 having a plurality of undercuts 128 along its height at its outer periphery towards the base plate holes 124 and a rotating unit or center section or an elevator ring 104 having one or more ramps 109 at its upper surface.

The method comprises the following steps. At one step, the air gun magazine 112 is inserted onto the magazine interface 106. In one embodiment, the undercuts 128 in the magazine interface 106 arrays it into the correct positions to line the holes 130 in the magazine 112 with the pellet sorter holes 108 in the pellet sorter 102. At step 202, a plurality of pellets 110 are poured into the pellet sorter 102. At step 204, the pellets 110 are sorted and loaded into the pellet sorter holes 108 with their head down in a closed position by swirling/shaking. At step 206, the pellet sorter 102 is raised by rotating the elevator ring 104 to an open position and bisects the pellet sorter holes 108. At step 208, a space is created by rotating the elevator ring 104 for the pellets 110, thereby allowing the pellets 110 to move in the direction of the raised section 126. At step 210, the pellets 110 directly fall through the round holes 108 into the air gun magazine 112 or open area.

Figure 14:
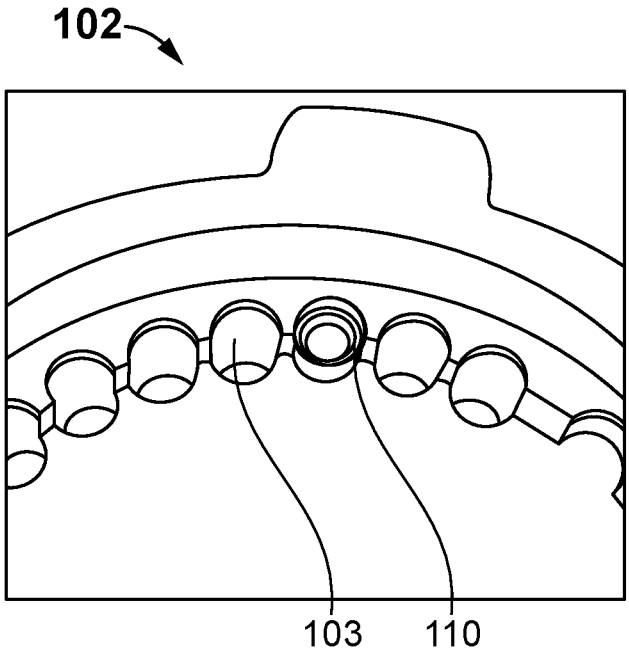
FIG. 14 shows an enlarged view of the magazine loading device in an open position in one embodiment of the present invention.
Figure 15:
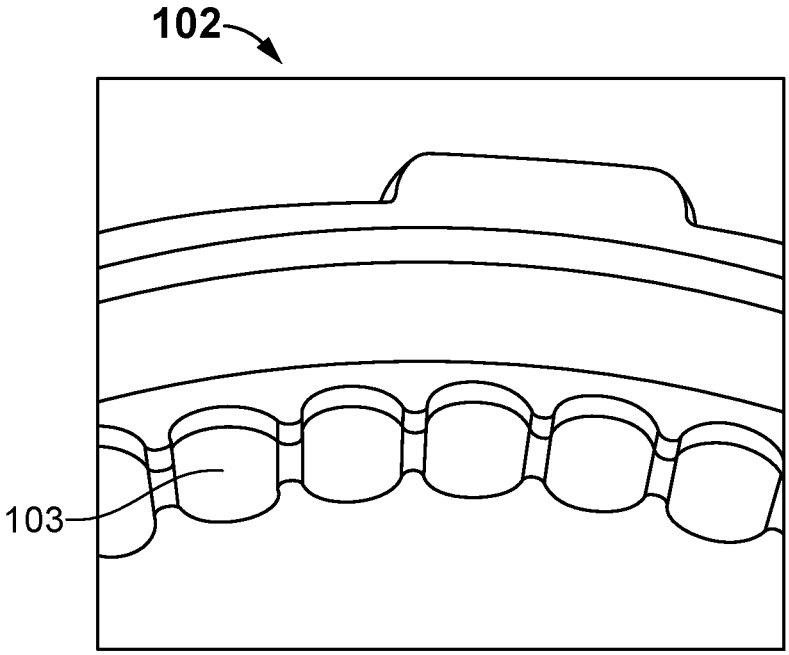
FIG. 15 shows an enlarged view of the magazine loading device in the open position with exposed undercuts in one embodiment of the present invention.

Referring to FIGS. 14-16, an enlarged view of the round holes or pellet sorter holes 108 in a closed position and an open position respectively, according to one embodiment of the present invention. In one embodiment, the pellets 110 are sorted into the pellet sorter holes 108 with their head down in the closed position by swirling/shaking. By rotating the elevator ring 104, the pellet sorter 102 is raised to an open position and bisects the pellet sorter holes 108, thereby creating a space for the pellets 110 and allowing the pellets 110 to move in the direction of the raised section 126. The pellet's head may have a smaller dimension than its skirt. The difference in the dimension allows effective positioning of the pellet's Head down, which is the direction the air gun magazine 112 requires loading of pellets 110. In one embodiment, the pellet sorter holes 108 may have different dimensions to allow larger pellet skirts to pass through.

Advantageously, the magazine loading device of the present invention is designed to provide an intelligent solution to sort and load the plurality of pellets in the air gun magazine. It provides easy, effective, and faster reloading/refilling of pellets in the air gun magazine. The device provides an automatic solution for sorting and loading the pellets into the air gun magazine. Further, the device may have different dimensions to support the loading of pellets with different dimensions.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A magazine loading device for an air gun, comprising:

a stationary unit comprising, a pellet sorter including a plurality of undercuts proximal to an outer edge thereof and an outer rim at a periphery thereof and a magazine interface having a base plate including a plurality of magazine holes and a raised section having a plurality of undercuts along a height thereof at an outer periphery thereof towards the holes in the base plate, wherein the pellet sorter forms a plurality of round, pellet sorter holes in a closed position configured to sort a plurality of pellets into the round, pellet sorter holes, wherein the magazine interface positions the plurality of magazine holes in-line with the round, pellet sorter holes; and, an elevator ring having at least one ramp at an upper surface, wherein the elevator ring is rotated to raise the pellet sorter to an open position and bisect the round, pellet sorter holes, thereby creating a space for the plurality of pellets and allowing the plurality of pellets to move toward the raised section where the plurality of pellets fall through the round, pellet sorter holes into an air gun magazine.

2. The magazine loading device of claim 1, wherein the plurality of pellets are sorted automatically into the air gun magazine.

3. The magazine loading device of claim 1, wherein the air gun magazine is inserted into the magazine interface to load the plurality of pellets.

4. The magazine loading device of claim 1, wherein the outer rim of the pellet sorter and the raised section of the magazine interface form a top sorting surface thereof thereby providing the plurality of round, pellet sorter holes for sorting plurality of pellets.

5. The magazine loading device of claim 1, wherein the plurality of undercuts in the magazine interface array the holes in the air gun magazine positions to align the holes in the air gun magazine with the holes in the pellet sorter.

6. The magazine loading device of claim 1, wherein the plurality of pellets are sorted into the pellet sorter holes head down in the closed position by swirling.

7. The magazine loading device of claim 1, wherein the elevator ring has at least one sliding holes at an outer periphery of the elevator ring.

8. The magazine loading device of claim 1, wherein the pellet sorter has at least one pellet sorter tabs and the magazine interface has at least one magazine interface tabs.

9. The magazine loading device of claim 8, wherein the at least one pellet sorter tabs and magazine interface tabs are positioned in-line and connected using at least one fasteners via the sliding holes of the elevator ring.

10. The magazine loading device of claim 9, wherein the fasteners are threaded screws.

11. The magazine loading device of claim 1, wherein the at least one ramps of the elevator ring are configured to support the rotation of the elevator ring.

12. The magazine loading device of claim 1, wherein the pellet sorter further comprises at least one channels configured to allow the at least one ramps to slide into the at least one channel to support the rotation of the elevator ring.

13. A method of loading a plurality of pellets into an air gun magazine using a magazine loading device having a pellet sorter including a plurality of undercuts proximal to an outer edge and an outer rim at a periphery thereof, a magazine interface having a base plate including a plurality of holes and a raised section having a plurality of undercuts along a height thereof at an outer periphery thereof towards the holes in the base plate, and an elevator ring having at least one ramps at an upper surface, wherein the method comprises the following steps of:

inserting the air gun magazine onto the magazine interface, wherein the plurality of undercuts in the magazine interface array it the holes in the air gun magazine positions to align the holes in the air gun magazine with the holes in the pellet sorter, sorting the plurality of pellets into the pellet sorter holes head down in a closed position by swirling, and rotating the elevator ring to raise the pellet sorter to an open position and bisect the round, pellet sorter holes, thereby creating a space for the plurality of pellets and allowing the plurality of pellets to move toward the raised section where the plurality of pellets fall through the round, pellet sorter holes into the air gun magazine.

14. The method of claim 13, wherein the plurality of pellets are sorted automatically into the air gun magazine.

15. The method of claim 13, wherein the pellet sorter forms the plurality of round, pellet sorter holes in a closed position to sort the plurality of pellets into the round, pellet sorter holes, wherein the magazine interface positions the plurality of magazine holes in-line with the round, pellet sorter holes.

* * * * *